United States Patent [19]

Peters et al.

[11] 4,077,914

[45] Mar. 7, 1978

[54] COMPOSITION AND METHOD FOR ELECTRIFYING A GASEOUS ATMOSPHERE

[75] Inventors: John P. Peters, Marietta; Larry H. McAmish, East Point, both of Ga.

[73] Assignee: Lester Laboratories, Inc., Atlanta, Ga.

[21] Appl. No.: 564,381

[22] Filed: Apr. 2, 1975

Related U.S. Application Data

[62] Division of Ser. No. 433,985, Jan. 16, 1974, Pat. No. 3,924,157.

[51] Int. Cl.[2] ..... H01B 1/06

[52] U.S. Cl. ..... 252/518; 252/1; 252/135; 252/529; 252/DIG. 1

[58] Field of Search ..... 252/518, 1, 529, 135, 252/DIG. 1; 317/2 A

[56] References Cited

U.S. PATENT DOCUMENTS

| | | | |
|---|---|---|---|
| 2,970,962 | 2/1961 | Hass et al. | 252/529 X |
| 3,210,286 | 10/1965 | Gangwisch et al. | 252/529 X |
| 3,337,463 | 8/1967 | Schmolka | 252/135 X |

*Primary Examiner*—Benjamin R. Padgett
*Assistant Examiner*—E. Suzanne Parr
*Attorney, Agent, or Firm*—Beveridge, DeGrandi, Kline & Lunsford

[57] ABSTRACT

A process for imparting a positive electrical charge to a gaseous stream comprises contacting the stream with an aqueous solution comprising about 500–3000 ppm of a composition consisting essentially of borax and a surfactant. In the composition, borax and the surfactant are present in a weight ratio of borax to surfactant of about 1.2:1 to about 15:1. The process and composition are useful in the control of static electricity.

20 Claims, 1 Drawing Figure

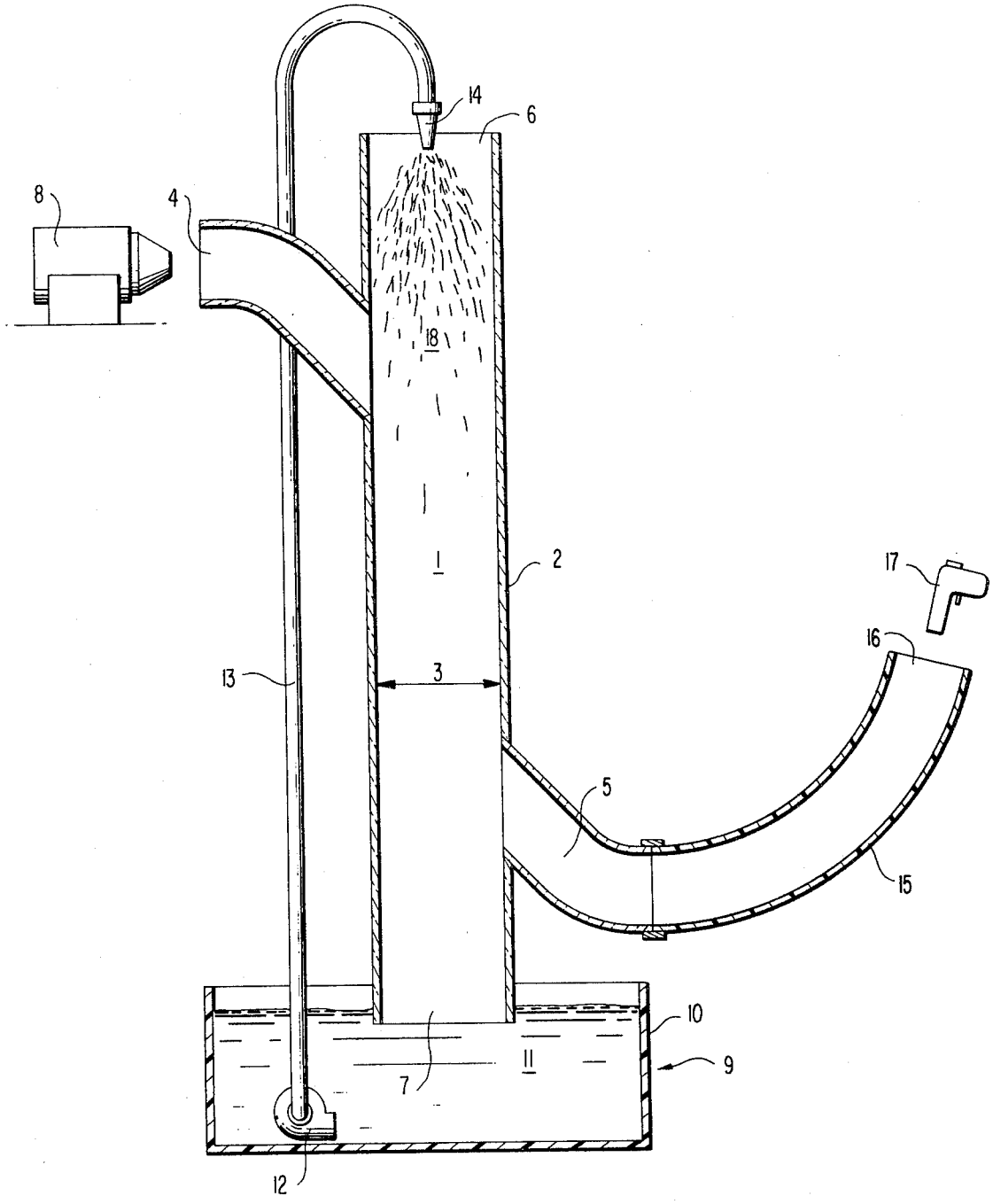
14
6
8
4
18
1
2
17
16
13
3
5
15
10
11
9
7
12

COMPOSITION AND METHOD FOR ELECTRIFYING A GASEOUS ATMOSPHERE

This is a division, of application Ser. No. 433,985 filed Jan. 16, 1974, now U.S. Pat. No. 3,924,157.

This invention relates to a process and composition for imparting a positive electrical charge to a gaseous stream, such as an air stream. More particularly, a positive electrical charge is imparted to a gaseous stream by spraying an aqueous solution of borax and a surfactant into the stream.

Imparting an electrical charge to a gaseous stream finds important industrial application, especially in neutralizing and controlling static electricity. One method for imparting such a charge to a gaseous stream is to spray a liquid into the stream.

In some cases, merely contacting the gaseous stream with a water spray has been found sufficient to impart an electrical charge to the stream. Generally, however, the electrical charge is only a few volts in magnitude.

In other cases, a high electrical potential is applied to a water spray before being contacted with the gaseous stream. These methods have not proved entirely satisfactory because of the electrical energy requirements, the safety hazards involved and periodic equipment breakdowns.

Still other methods involve the use of radioactive substances. These methods have not proved entirely satisfactory because of the cost of the radioactive materials and the hazards involved in handling such materials. Furthermore, systems employing radioactive materials can be rather costly because of the safeguards which must be provided in these systems.

Accordingly, there exists a need for a process and composition for imparting an electrical charge to a gaseous stream. The process and composition should be of relatively low cost, fairly simple and safe to use without the need for costly equipment and capable of producing a substantial electrical charge in the gaseous stream.

Accordingly, this invention provides a process for imparting a positive electrical charge to a gaseous stream by contacting the stream with an aqueous solution. Specifically, contacting is effected by spraying into the gaseous stream an aqueous solution comprising about 500–3000 ppm of a composition consisting essentially of borax and at least one surfactant selected from the group consisting of a. a nonionic surfactant having an HLB number of 6.6,
b. a nonionic surfactant having an HLB number of 3.0,
c. a liquid, nonionic, fatty acid alkylolamide,
d. a nonionic polyethyleneoxide based, terminated alkyl aryl ether, and
e. a liquid, anionic, biodegradable, modified ethoxylate.

The borax and surfactant are present in the aqueous solution in a weight rato of borax to surfactant of about 1.2:1 to about 15:1. The contacting is conducted for about 0.1–10 seconds at a temperature between about 15° C and the boiling point of the aqueous solution.

This invention also pvovides a water soluble composition consisting essentially of borax and at least one surfactant selected from the aforementioned group. The weight ratio of borax to surfactant in the composition is about 1.2:1 to about 15:1.

This invention further provides an aqueous solution containing about 500–3000 ppm of the water soluble composition of this invention.

It has surprisingly been found that borax and the surfactant interact in a synergistic manner to produce a positive electrical charge of about 40–100 volts or more, preferably about 40–80 volts, when sprayed as an aqueous solution into a gas stream. The composition of this invention is of relatively low cost since the major ingredient, borax, is readily available at low cost. Furthermore, the process of this invention is simple to operate on a large or small scale, and does not involve the use of costly specialized equipment. In fact, air washing equipment frequently found in industrial plants can be used in practicing this invention. The water soluble composition of this invention, the aqueous solution containing this composition and the process of this invention do not present any new or unusual safety hazards. The process is relatively simple to operate since it involves liquid-gas contact by means of a spraying system.

The FIGURE is a diagrammatic illustration of the apparatus employed in the Examples set forth hereinafter.

As used herein the term "consisting essentially of" has its generally accepted meaning as requiring that specified components be present, but not excluding unspecified components which do not materially detract from the basic and novel characteristics of the invention.

The term "spraying" is to be understood as the process of dispersing a liquid in a gas, and the products obtained from such a process include sprays, mists, and fogs. Essentially, the spraying operation employed in this invention involves the formation of a suspension or dispersion of droplets in a gas.

The process of this invention involves imparting a positive electrical charge to a gaseous stream. Generally, the gaseous stream will be an air stream. Other gaseous streams can be employed provided that the constitutents of the gas stream do not substantially chemically react with the borax or surfactant. Thus, an inert gas stream can be employed. Typical of the constituents in such an inert gas stream are nitrogen, carbon dioxide, and the inert gases, such as helium, neon, argon, krypton and xenon. The gaseous stream can be a single element or compound or mixture of several elements and compounds. The term "gaseous stream" is intended to include both gases and vapors.

The spraying operation employed in this invention can be conducted in spray systems well known in the art. A number of spray systems are in commerical use. Typical of such systems are spray columns, cyclone sprayers, venturi air washers, and jet scrubbers or washeres. The spray system generally includes a spray nozzle or a series of spray nozzles which can form, for example, a spray manifold.

The spray nozzle employed in this invention has not been found to be critical. As used herein, the term "spray nozzle" refers to the device for breaking into droplets the aqueous solution containing the composition of this invention. Generally speaking, the spray nozzle can be a pressure nozzle, rotating nozzle (spinning atomizer) or a gas-atomizing nozzle (two fluid nozzle, pneumatic atomizer). Spray nozzles employed in air moistening, air washing, humidification, scrubbing and washing of gases are well known in the art. Typical examples of nozzles include solid-cone wide-angle sprayers, narrow-angle sprayers, hollow-cone sprayers, pressure atomizing spray nozzles, air- or gas-atomizing sprayers and rotating-disk sprayers.

It has been found that temperature has an effect on the magntiude of the positive electrical charge imparted to the gaseous stream. The contacting temperature should be between about 15° C and the boiling point of the aqueous solution comprising the composition of this invention. Preferably, the temperature will be about 20°–60° C with a temperature of about 30°–55° C being particularly preferred. Within these preferred temperature ranges, the rate of increase in the electrical charge with increases in temperature is the greatest. It has been discovered that the positive electrical charge increases with increasing temperature. When the particularly preferred composition of this invention is employed at a concentration of about 500 ppm in an aqueous solution, the rate of increase in positive electrical charge is greatest between about 20° and 50° C. The electrical charge continues to gradually increase between about 50° or 55° C and the boiling point of the aqueous solution.

Generally, the spraying temperature is controlled by heating the aqueous solution being sprayed to a temperature between about 15° C and the boiling point of the solution. However, it is to be understood that the gaseous stream can be heated instead of the aqueous solution being sprayed, or both the gaseous stream and aqueous solution can be heated.

It has also been discovered that the time during which the spray of aqueous solution contacts the gaseous stream affects the magnitude of the positive electrical charge imparted to the gaseous stream. The magnitude of the electrical charge increases with increases in contact time. Typically, the contact time is about 0.1–10 seconds. Preferably, the contact time is about 0.5–2.5 seconds since most commercial spray systems operate within this range. A particularly preferred contact time is about 0.6–0.8 seconds.

It will be understood that most spray systems include a spray chamber fitted with the spray nozzle or spray manifold. It is within this chamber that the gaseous stream is contacted with the spray of the aqueous solution. Thus, contact time refers to the average residence time of an incrementa volume of the gaseous stream within this chamber.

If the ratio of borax to surfactant is too low or too high, these materials do not interact in a synergistic manner to produce the relativey high positive electrical charges in the gaseous stream. Thus, the weight ration of borax to surfactant in the composition of this invention and in the aqueous solution employed in the process of this invention is about 1.2:1 to about 15:1, preferably about 4:1 to about 7:1.A weight ratio of about 5:1 to about 6:1 is particularly preferred. The particularly preferred composition of this invention in which the surfactant has an HLB number of 6.6 has a borax to surfactant weight ratio of about 5.7:1.

The aqueous solution employed in the process of this invention contains the composition of this invention in a concentration of about 500–3000 ppm, preferably about 1000–3000 ppm. A concentration of about 1200–2200 ppm is particularly preferred. When the composition is employed at these levels, a positive electrical charge of about 40–80 volts or more can be imparted to an air stream.

The water soluble composition of this invention comprising the borax and surfactant in the indicated weight ratio can be prepared by conventional blending techniques. Since the borax is generally in a particulate, solid form, a conventional solids mixer can be employed. Since the surfactant is generally in liquid form, it has been found adequate to merely sprinkle the surfctant over the borax which is being agitated in the mixer. If large amounts of surfactant are added to the borax, the resulting product may assume a pasty consistency. In this event, a conventional paste mixer may be more efficient.

The water soluble composition of this invention can be dissolved in water by simply gradually adding the composition to the water while stirring the resulting aqueous solution. The amount of the water soluble composition in the aqueous solution is generaly below the solubility product concentration. When the aqueous solution is heated, it will be understood that care should be exercised in controlling the amount of water evaporated from the aqueous solution so that the concentration of borax and surfactant does not exceed the solubility product concentration.

As used herein, the term "borax" refers to sodium borate and its various hydrates. Typical of the sodium borate-hydrates are the decahydrate, metaborate, metaboratetetrahydrate, tetraborate, tetraborate pentahydrate and perborate and its hydrates. The borax can be used in any of its technical and commercial grades.

The surfactant employed in this invention is selected from the group consisting of a. a nonionic surfactant having an HLB number of 6.6,
b. a nonionic surfactant having an HLB number of 3.0,
c. a liquid, nonionic, fatty acid alkylolamide,
d. a nonionic polyethyleneoxide based, terminated alkyl aryl ether, and
e. a liquid, anionic, biodegradable, modified ethoxylate. The particularly preferred composition of this invention contains a nonionic surfactant having an HLB number of 6.6. A specific example of such a surfactant is Pluronic L-62-LF. Pluronic L-62-LF is a condensate of ethylene oxide with a hydrophobic baseformed by condensing propylene oxide with propylene glycol. It is a liquid which is available in 100 percent concentration.

Another surfactant suitable for use in this invention is a nonionic surfactant having an HLB number of 3.0. An example of a commercially available surfactant of this type is Pluronic L-61, which is similar in chemical structure to Pluronic L-62-LF. Both are available from Wyandotte Chemical Corp.

More particularly, Pluronic L-61 and Pluronic L-62-LF are polyoxyethylene compounds terminated at each end of the molecule by hydrophilic polyoxyethylene groups. They can be represented by the simplified structure:

$$HO(CH_2CH_2-O)_a(\underset{\underset{CH_3}{|}}{CH_2}-CH_2-O)_b(CH_2CH_2-O)_cH$$

Pluronic L-61 is a liquid having a total average molecular weight of about 1950 and an average molecular weight of the polyoxypropylene base of about 1750. Pluronic L-62-LF is a liquid having an average molecular weight of about 2200, of which about 1750 comprises the polyoxypropylene base.

Still other examples of nonionic surfactants suitable for use in this invention are a liquid fatty acid alkylolamide and a nonionic polyethyleneoxide based terminated alkyl aryl ether. These are commercially available under the trade names Stepan HDA-7 and Triton CF-87, respectively. Stepan HDA-7 is available from Stepan Chemical Co. of Northfield, Illinois, while Triton CF-87 is available from Rohm and Haas Company of Philadelphia, Pennsylvania.

Another surfactant found suitable for use in this invention is Triton DF-20, which is an anionic, biodegradable, modified ethoxylate available in liquid form from Rohm and Haas Company.

The term "HLB number" is used herein in its conventional sense as being an expression of the hydrophile-lipophile balance of the surfactant. It is a measure of the size and strength of the hydrophilic and the lipophilic groups of the surfactant.

The borax and surfactant interact to produce synergistic results. That is, the positive electrical charge imparted to the gas stream when an aqueous solution of borax and surfactant are sprayed into the stream is substantially greater than the electrical charge imparted by either borax alone or the surfactant alone.

The composition of this invention can include other additives which do not materially detract from its ability in aqueous solution to impart a positive charge to a gas stream. Typical of other ingredients which can be included are anti-foaming agents, corrosion inhibitors, anti-caking agents, anti-oxidants, colorants, such as dyes and pigments, buffering agents, lubricants, anti-bacterial and anti-fungicidal agents, etc.

An example of a formulation which has been found to be effective in this invention comprises the following ingredients in parts by weight:

Sodium nitrite: about 58 parts
Borax: about 28 parts
Nitrilotriacetic acid sodium salt: about 10 parts
Pluronic L-62-LF: about 4 parts
Petro AG Powder: about 0.2 parts.

The sodium nitrite acts as a corrosion inhibitor. The sodium salt of nitrolotriacetic acid acts as a chelating agent for any calcium ions which may be present, thereby inhibiting the formation of scale on process equipment. The Petro AG Powder is a sulfonated surfactant which acts as an anti-caking agent. Anti-caking agents of this type are frequently found in commercial grades of sodium nitrate, and additional amounts can be added, if necessary, to the composition of this invention. This composition is preferred since it is capable of imparting a positive electrical chart of about 40–80 volts when sprayed as an aqueous solution at a concentration level in the solution of about 1500–3000 ppm.

The FIGURE is an illustration of the air washer apparatus employed in the Examples set forth hereinafter.

An air-washing chamber 1 is formed by a glass drain-pipe 2 having a diameter 3 of 6 inches and an overall length of 42 inches. The glass pipe 2 is open at both ends. The glass pipe 2 is provided with an air inlet 4 and an air outlet 5. The air inlet and air outlet are each 4 inches in diameter. Air inlet 4 and air outlet 5 are spaced 21 inches between centers. The distance between air inlet 4 and the top 6 of the glass pipe 2 is about equal to the distance between air outlet 5 and the bottom 7 of the glass pipe 2. The air inlet 4 and air outlet 5 are each mounted at a 45° angle to the glass pipe 2.

An air blower 8 is provided adjacent to the air inlet 4 to provide the gas stream, in this case, an air stream. The air blower employed was a Root Lowell Model 1020 Sprayer operating at a capacity of 120 CFM (STP).

A sump generally indicated as 9 is provided and comprises a 5 gallon tank formed by a plastic pan 10. The sump 9 contains an aqueous solution 11 of the composition of this invention or other material to be sprayed into the gaseous stream.

Sump 9 is also provided with a submersible pump 12. A plastic garden hose 13 is connected to the discharge of submersible pump 12 and extends to the top 6 of glass pipe 2. At the end of hose 13 there is connected an adjustable brass garden hose nozzle 14.

Air outlet 5 is provided with a flexible, plastic duct 15 having a diameter of 4 inches. At the outlet 16 of duct 15 there is provided a static meter 17. The static meter employed was a Model 1127C meter manufactured by B. K. Sweeney of 6300 Stafleton South Drive, Denver, Colorado.

During operation, an air stream (not shown in the FIGURE) is generated by air blower 8, enters air inlet 4, passes vertically downward through air chamber 1, and exits the chamber through air outlet 5. Duct 15 is about 2 feet long and is curved upwardly as shown in the FIGURE. The curve in the duct aids in the removal of entrained water from the air stream.

The aqueous solution is recirculated in the system. This is accomplished by submersible pump 12 drawing a portion of the solution from sump 9, forcing it through hose 13 to nozzle 14, where it is converted into a spray 18 of droplets. A major portion of the droplets fall vertically through air chamber 1 into sump 9.

The static charge of the air stream existing at 16 is measured by placing the static meter 17 in the middle of the end of the duct. The voltage of the charged air stream is read directly from the meter. In all cases, the meter is initially set at 0 with only the air stream passing through the air chamber 1; that is, none of the aqueous solution 11 is pumped to the nozzle 14. After the static meter 17 has been calibrated to read zero with only an untreated air stream exiting at 16, the submersible pump 12 is turned on, and the charge in the charge of the air stream is measured by reading the charge from static meter 17.

This arrangement has been found to be convenient for testing various aqueous solutions. For example, aqueous solution 11, can be an aqueous solution of the water soluble composition of this invention, borax alone, a surfactant alone, or various other combinations of chemical additives.

All of the positive voltages expressed herein are relative values in that they were all measured with a static meter set at zero for an untreated air stream, the increase in voltage then read for a treated air stream. Thus, a voltage of +40 means that the voltage increased from 0 to +40 when an air stream was treated with the composition of this invention. Thus, the voltages expressed herein can be considered as voltage increases from a base value.

This invention will now be more fully understood by reference to the following Examples in which all parts, proportions, ratios and percentages are by weight unless otherwise indicated. The temperature of the solution sprayed into the air stream is 19° C. unless otherwise indicated. The water used in all Examples was tap water from the public water supply of the city of East Point, Georgia.

EXAMPLE 1

A composition comprising 58 parts sodium nitrite, 28 parts borax, 10 parts nitrilotriacetic acid sodium salt, 4 parts Pluronic L-62-LF, and 0.2 parts Petro AG Powder is dissolved in water at the concentration levels indicated in Table 1.

The voltage of an air stream treated with each of the aqueous solutions is also recorded in the following Table.

TABLE 1

| ppm of Composition in Aqueous Solution | + Volts |
|---|---|
| 0 | 0 |
| 100 | 10 |
| 200 | 15 |
| 300 | 15 |
| 400 | 25 |
| 500 | 25 |
| 600 | 25 |
| 1000 | 30 |
| 1500 | 40 |
| 2000 | 80 |
| 2500 | 80 |
| 3000 | 80 |

It is apparent from this data that there is a substantial increase in the voltage from 40 volts to 80 volts as the concentration is increased from 1500 to 2000 ppm.

EXAMPLE 2

A composition similar to that employed in Example 1, but with zero parts by weight by Pluronic L-62-LF, is dissolved in water at various concentration levels. The concentration of this composition in ppm in the water and the voltage of an air stream treated with a spray of the resulting aqueous solution are set forth in Table 2.

TABLE 2

| ppm of Composition in Aqueous Solution | + Volts |
|---|---|
| 0 | 0 |
| 100 | 0 |
| 200 | 0 |
| 300 | 0 |
| 400 | 0 |
| 500 | 5 |
| 750 | 15 |
| 1000 | 25 |
| 1500 | 25 |
| 2000 | 25 |

It is apparent from this data that there is a gradual increase in voltage between concentration levels of 500 and 1000 ppm, but increases in the concentration from 1000 to 2000 ppm have no apparent effect. This example highlights the importance of the presence of a surfactant in combination with borax.

EXAMPLE 3

The composition of Example 2 is dissolved in tap water to yield an aqueous solution having a concentration of 2000 ppm. Varying amounts of Pluronic L-62-LF surfactant are added to this solution.

The concentration of surfactant, the borax: L-62-LF weight ratio and the voltage of an air stream treated with the aqueous solution containing the surfactant are set forth in the following Table.

TABLE 3

| ppm L-62-LF | Borax: L-62-LF | +Volts |
|---|---|---|
| 4 | 14.5:1 | 25 |

TABLE 3-continued

| ppm L-62-LF | Borax: L-62-LF | +Volts |
|---|---|---|
| 16 | 36.4:1 | 30 |
| 20 | 29.1:1 | 50 |
| 30 | 19.4:1 | 50 |
| 40 | 14.5:1 | 50 |
| 60 | 9.7:1 | 55 |
| 80 | 7.29:1 | 80 |
| 120 | 4.85:1 | 80 |

This data highlights the importance of the presence of a surfactant in combination with borax. Furthermore, it highlights the importance of the ratio between the surfactant and the borax.

EXAMPLE 4

A first solution is prepared by dissolving Pluronic L-62-LF in tap water. Varying amounts of the composition of Example 2 are added to this first solution to form a second solution.

The amount of the composition of Example 2 in the second solution and the voltage of an air stream treated with a spray of the second solution are set forth in the following Table.

TABLE 4

| ppm of Composition of Example 2 in 2nd Solution | Borax: L-62-LF | + Volts |
|---|---|---|
| 500 | 0.485:1 | 25 |
| 1000 | 0.97:1 | 25 |
| 1500 | 1.46:1 | 40 |
| 2000 | 1.94:1 | 50 |
| 2500 | 2.42:1 | 80 |

The results of these tests are similar to the results obtained in Example 3 in that they highlight the importance of the presence of a surfactant in combination with borax. Additionally, the data of this Example points up the importance of the relative proportions of borax and surfactant at low ratios of borax to surfactant.

EXAMPLE 5

Another example is conducted to demonstrate the effects of an anionic surfactant in combination with borax. The surfactant was Triton DF-20 marketed by Rohm and Haas.

The relative proportions of surfactant and borax in tap water are set forth in the following Table. The voltages imparted to an air stream into which the resulting aqueous solutions are sprayed are also set forth in the following Table.

TABLE 5

| ppm DF-20 | ppm BORAX | + Volts |
|---|---|---|
| 100 | 0 | 5 |
| 100 | 2000 | 35 |
| 1000 | 2000 | 55 |

EXAMPLE 6

Another series of tests is conducted to determine the effects of an aqueous solution of boric acid on the electrical charge imparted to an air stream into which the aqueous solution is sprayed. The concentration of boric acid in tap water, the pH of the resulting solution and the voltage of the treated air stream are set forth in the following Table.

TABLE 6

| ppm BORIC ACID | pH | + Volts |
|---|---|---|
| 0 | 7.0 | 0 |
| 100 | 7.0 | 0 |
| 500 | 7.0 | 0 |
| 2000 | 7.0 | 0 |
| 2000 | 8.5 | 0 |
| 2000 | 10.5 | 0 |
| 2000 | 13.0 | 0 |

EXAMPLE 7

A further series of tests is conducted to determine the effects of aqueous solutions of each of the components of the composition of Example 1. Again, tap water from the public water supply of East Point, Georgia was employed in preparing each of the aqueous solutions. The concentration of each ingredient and the voltages obtained are set forth in the following tabulation.

TABLE 7

| L-62-LF | |
|---|---|
| ppm L-62-LF | + Volts |
| 0 | 0 |
| 100 | 5 |
| 200 | 5 |
| 300 | 20 |
| **BORAX** | |
| ppm BORAX | + Volts |
| 50 | 25 |
| 100 | 40 |
| 200 | 40 |
| 500 | 40 |
| 1000 | 40 |
| 1500 | 45 |
| 2000 | 45 |
| **$NaNO_2$** | |
| ppm $NaNO_2$ | + Volts |
| 100 | 0 |
| 500 | 0 |
| 1000 | 0 |
| 2000 | 0 |
| **$Na_3NTA$** | |
| ppm $NA_3NTA$ | + Volts |
| 100 | 0 |
| 500 | 5 |
| 1000 | 5 |
| 2000 | 5 |
| **2000 ppm $NaNO_2$ + $NaNTA_3$** | |
| ppm $Na_3NTA$ | + Volts |
| 100 | 0 |
| 500 | 5 |
| 1000 | 5 |
| 2000 | 5 |

EXAMPLE 8

A series of tests is conducted to determine the effect of a hygroscopic inorganic salt other than borax in combination with a nonionic surfactant. In this case, calcium chloride and Pluronic L-62-LF are dissolved in tap water. The concentration of each ingredient in the tap water and the voltage imparted to an air stream treated with a spray of the aqueous solution is set forth in the following Table.

TABLE 8

| $CaCl_2$ ppm | ppm L-62-LF | + Volts |
|---|---|---|
| 100 | 0 | 0 |
| 2000 | 0 | 0 |
| 2000 | 100 | 0 |
| 2000 | 500 | 0 |

EXAMPLE 9

The following series of tests demonstrates the effect of temperature on the charge imparted to an air stream treated with a spray of an aqueous solution of the same composition employed in Example 1. In this case, the composition was dissolved in tap water to yield an aqueous solution having a concentration of 500 ppm of the composition of Example 1.

Temperature is varied by employing combinations of hot and cold tap water. The low temperatures are obtained by adding ice to the tap water as required. The higher temperatures are obtained by inserting an immersion heater in the sump. The results obtained from these tests are set forth below.

TABLE 9

| Temperature (° C) | + Volts |
|---|---|
| 10° | 0 |
| 20° | 10 |
| 30° | 40 |
| 40° | 75 |
| 50° | 140 |
| 60° | 160 |
| 70° | 175 |

This data, when compared with the other examples, demonstrate that the borax and surfactant interact in a synergistic manner. That is, the voltage imparted to an air stream treated with an aqueous solution containing borax and surfactant is greater than the mere additive effects of each. For example, referring to Example 1, at a concentration level of 2000 ppm of treatment agent, a charge of 80 volts is imparted to an air stream. Of these 2000 ppm, 560 ppm comprise borax (0.28 × 2000 ppm) and 80 ppm, i.e. (0.04 × 2000 ppm), comprise Pluronic L-62-LF. Based on the data in Example 7 the portion of the charge contributed by the surfactant should be 5 volts or less (i.e. at 100 ppm L-62-LF), while the charge contributed by the borax should be only about 40 volts (between 500 and 1000 ppm), thus a total of 45 volts. Surprisingly, however, borax and this same surfactant interact in a synergistic manner to impart an electrical charge of 80 volts to an air stream (Example 1).

EXAMPLE 10

Another series of tests demonstrate the effect obtained by varying the weight ratio of borax and surfactant. The same procedure as outlined in the foregoing examples is employed. The results are set forth in the following Table.

TABLE 10

| ppm BORAX | Ratio Borax:L-62-LF | + Volts |
|---|---|---|
| 500 | 20:1 | 10 |
| 500 | 10:1 | 15 |
| 500 | 6.67:1 | 20 |
| 2000 | 20:1 | 25 |
| 2000 | 10:1 | 40 |
| 2000 | 6.67:1 | 55 |
| 2000 | 4:1 | 55 |
| 4000 | 8:1 | 55 |

Relatively large and troublesome amounts of static electricity are frequently generated in textile and paper mills. Where the charge generated in these installations is a negative charge, this invention is especially useful for neutralizing such static electricity. This can conveniently be accomplished by spraying the composition of this invention into an air washer of the type conventionally employed in such installations. Thus, this invention is particularly advantageous since additional costly equipment is frequently not required.

There are othe advantages provided by this invention. First of all, the composition of this invention is of relatively low cost because of the ready availability of the borax and surfactant. Secondly, the compositions of this invention are fairly simple to prepare since conventional mixing and blending equipment can be used. Furthermore, the compositions are safe and easy to handle. Finally, the compositions and process of this invention make it possible to impart a relatively large electrical charge to a gaseous stream. Where lower charges are desired, smaller amounts of the composition of this invention can be employed, the ratio of borax to surfactant can be varied, the temperature of operation can be controlled, or the contact time shortened.

What is claimed is:

1. A water soluble composition consisting essentially of borax and a surfactant selected from the group consisting of:

a. a nonionic surfactant having an HLB number of 6.6, b. a nonionic surfactant having an HLB number of 3.0, and c. a liquid, nonionic, fatty acid alkylolamide, the weight ratio of borax to surfactant being about 1.2 : 1 to about 15 : 1, wherein an aqueous solution containing about 500 – 3000 ppm of said composition is capable of increasing by at least about 40 percent the positive electrical charge in a gas stream into which said aqueous solution is sprayed.

2. A water soluble composition according to claim 1 in which said weight ratio is about 4:1 to about 7:1.

3. A wate soluble composition according to claim 1 in which said weight ratio is about 5:1 to about 6:1.

4. A water soluble composition according to claim 1 in which said weight ratio is about 5.7:1.

5. A water soluble composition according to claim 1 in which the surfactant has an HLB number of 6.6, said weight ratio being about 5.7:1.

6. An aqueous solution containing about 500 – 3000 ppm of the composition of claim 1.

7. An aqueous solution containing about 1000 – 3000 ppm of the composition of claim 3.

8. An aqueous solution comprising about 1200 – 2200 ppm of the composition of claim 4.

9. A water soluble composition according to claim 1 wherein said surfactant is a nonionic surfactant having an HLB number of 6.6

10. A water soluble composition according to claim 1 wheein said surfactant is a nonionic surfactant having an HLB number of 3.0.

11. A water soluble composition according to claim 1 wherein said surfactant is a liquid, nonionic, fatty acid alkylolamide.

12. A water soluble composition according to claim 1 wherein said composition consists of borax and a nonionic surfactant having an HLB number of 6.6, wherein said weight ratio of borax to surfactant is about 4 : 1 to about 7 : 1.

13. A water soluble composition according to claim 12 wherein said weight ratio of borax to surfactant is about 5 : 1 to about 6 : 1.

14. An aqueous solution according to claim 6 wherein said surfactant is a nonionic surfactant having an HLB number of 6.6.

15. An aqueous solution according to claim 6 wherein said surfactant is a nonionic surfactant having an HLB number of 3.0.

16. An aqueous solution according to claim 6 wherein said surfactant is a liquid, nonionic, fatty acid alkylolamide.

17. An aqueous solution according to claim 6 consisting of water, borax and a nonionic surfactant having an HLB number of 6.6.

18. An aqueous solution according to claim 17 in which said borax and said surfactant are in a weight ratio of about 4 : 1 to about 7 : 1.

19. An aqueous solution according to claim 17 in which said weight ratio of borax to surfactant is about 5 : 1 to about 6 : 1.

20. An aqueous solution according to claim 6 wherein said surfactant is a nonionic surfactant having an HLB number of 6.6 and said ratio of borax to surfactant is about 4 : 1 to about 7 : 1.

* * * * *